US009584926B2

(12) United States Patent
Maier

(10) Patent No.: US 9,584,926 B2
(45) Date of Patent: Feb. 28, 2017

(54) IMPLANTABLE MICROPHONE

(75) Inventor: Hannes Maier, Hamburg (CH)

(73) Assignee: Advanced Bionics AG, Staefa (CH)

( * ) Notice: Subject to any disclaimer, the term of this patent is extended or adjusted under 35 U.S.C. 154(b) by 445 days.

(21) Appl. No.: 14/004,899

(22) PCT Filed: Mar. 17, 2011

(86) PCT No.: PCT/EP2011/054059

§ 371 (c)(1),
(2), (4) Date: Nov. 22, 2013

(87) PCT Pub. No.: WO2011/064409

PCT Pub. Date: Jun. 3, 2011

(65) Prior Publication Data

US 2014/0073841 A1 Mar. 13, 2014

(51) Int. Cl.

| | |
|---|---|
| ***H04R 25/00*** | (2006.01) |
| ***H04R 1/22*** | (2006.01) |
| ***H04R 1/46*** | (2006.01) |
| *H04R 1/04* | (2006.01) |
| *H04R 3/00* | (2006.01) |

(52) U.S. Cl.

CPC ..... *H04R 25/00* (2013.01); *H04R 1/222* (2013.01); *H04R 1/46* (2013.01); *H04R 1/04* (2013.01); *H04R 3/005* (2013.01); *H04R 2225/67* (2013.01)

(58) Field of Classification Search

CPC ..... H04R 25/606; H04R 2225/67; A61N 1/36032

USPC ..... 600/25; 607/57

See application file for complete search history.

(56) References Cited

U.S. PATENT DOCUMENTS

| | | | |
|---|---|---|---|
| 5,859,916 | A | 1/1999 | Ball et al. |
| 6,093,144 | A | 7/2000 | Jaeger et al. |
| 6,381,336 | B1 | 4/2002 | Lesinski et al. |
| 6,516,228 | B1 | 2/2003 | Berrang et al. |
| 6,554,761 | B1 | 4/2003 | Puria et al. |
| 6,626,822 | B1 | 9/2003 | Jaeger et al. |
| 6,736,771 | B2 | 5/2004 | Sokolich et al. |
| 7,214,179 | B2 | 5/2007 | Miller, III et al. |

(Continued)

FOREIGN PATENT DOCUMENTS

| | | |
|---|---|---|
| WO | WO-2007/001989 | 1/2007 |

OTHER PUBLICATIONS

International Search Report and Written Opinion received in International Application No. PCT/EP2011/054059 dated Jan. 3, 2012.

*Primary Examiner* — Navin Natnithithadha
*Assistant Examiner* — Sunita Reddy
(74) *Attorney, Agent, or Firm* — ALG Intellectual Property, LLC

(57) ABSTRACT

An implantable microphone for placement in soft tissue, comprising a sensor arrangement comprising a housing, a first pressure sensor having a first membrane for being exposed to surrounding soft tissue and a second pressure sensor having a second membrane for being exposed to surrounding soft tissue and a compensation circuitry for combining the output signals of the first and second sensor in a manner so as to eliminate signals resulting from acceleration forces acting on the sensor arrangement, wherein the first and the second sensor are of a mirror-symmetric design with regard to each other, with the first and the second membrane being arranged parallel to each other.

18 Claims, 3 Drawing Sheets

(56) References Cited

U.S. PATENT DOCUMENTS

| | | | | |
|---|---|---|---|---|
| 7,556,597 | B2 | 7/2009 | Miller, III et al. | |
| 7,840,020 | B1 * | 11/2010 | Miller, III | H04R 25/604 381/326 |
| 2001/0031908 | A1 * | 10/2001 | Buschek | H04R 25/606 600/25 |
| 2005/0137447 | A1 | 6/2005 | Bernhard | |
| 2005/0197524 | A1 | 9/2005 | Miller, III et al. | |
| 2005/0222487 | A1 * | 10/2005 | Miller, III | H04R 25/604 600/25 |
| 2006/0155346 | A1 | 7/2006 | Miller, III | |
| 2007/0230721 | A1 * | 10/2007 | White | H04R 19/005 381/166 |
| 2009/0187065 | A1 | 7/2009 | Basinger | |
| 2012/0183165 | A1 * | 7/2012 | Foo | H04R 25/50 381/314 |

* cited by examiner

IMPLANTABLE MICROPHONE

The invention relates to an implantable microphone for placement in soft tissue of a patient.

Fully implantable hearing aids require biocompatibility and the possibility to implant all components of the device, in particular also the microphone.

Most current designs for implantable microphones achieve the requirement for biocompatibility by using an air adapted microphone in a hermetic housing with a membrane facing the skin surface, see for example U.S. Pat. No. 5,859,916, U.S. Pat. No. 6,516,228, U.S. Pat. No. 6,093,144, U.S. Pat. No. 6,381,336 and U.S. Pat. No. 6,736,771. In such microphones a compliant membrane faces on one side tissue and on the other side the air filled interior, making it prone to accelerations perpendicular to the microphone membrane with the acceleration artifact being due to the mass loading by overlying tissue of the compliant membrane. Thus, when the overlying mass is accelerated, it is suspended neither by the membrane nor by the air filling of the housing, with a membrane displacement relative to the housing being generated which is sensed equally sensitive as sound pressure generated membrane displacement. One approach to reduce sensitivity to acceleration is to use a plurality of small diaphragms in a stiff membrane attached to the housing covering and shielding the sound sensitive membrane, see U.S. Pat. No. 5,859,916 and U.S. Pat. No. 6,626,822 B1.

Another approach to reduce acceleration effects on perceived sound is described in US 2005/0197524 A1, wherein a soft damping material is inserted between the microphone housing and the underlying bone, thereby also reducing external forces acting on the microphone housing from the underlying bone of higher density.

U.S. Pat. No. 7,556,597 B2 relates to an implantable microphone including an active damping mechanism which is operated according to a motion signal provided by a motion sensor included within the microphone housing. A similar system is described in US 2006/155346 A1.

U.S. Pat. No. 7,214,179 B2 relates to an implantable microphone comprising an acceleration sensor for distinguishing acceleration forces from sound signals, wherein the output of the acceleration sensor is used to filter the microphone signal in a manner so as to eliminate acceleration signals. Such filtering may be achieved by appropriate audio signal processing. According to one example of U.S. Pat. No. 7,214,179 B2 a microphone diaphragm exposed to tissue outside the housing and acting on a first enclosed space and a cancellation diaphragm located inside the microphone housing and provided with a cancellation mass for acting on a second enclosed space are provided, with the pressure fluctuations in the first enclosed space being measured by a first microphone element and with the pressure fluctuations in the second enclosed space being measured by a second microphone element. The microphone diaphragm and the cancellation diaphragm are oriented parallel to each other and have substantially equal resonance frequencies. The outputs of the two microphone elements are electrically combined for allowing individually processing/filtering of one or more characteristics, such as gain, of each signal.

A different approach for capturing ambient sound by an implanted input transducer is to use ossicular middle ear structures which are as sensitive to mass loading than microphones implanted in soft tissue or bone structures, since the middle ear apparently has some damping effect for acceleration induced artifacts. US 2005/0137447 A1 relates to an acceleration sensor placed on the ossicles for capturing audio signals. U.S. Pat. No. 6,554,761 B1 relates to an flextensional microphone comprising an acceleration sensor on the tympanic membrane. U.S. Pat. No. 6,381,336 relates to a disc-shaped implanted microphone for implantation into an artificial mastoid bone cavity.

WO 2007/001989 A2 relates to a microphone which is to be implanted in soft tissue at a location spaced from the surface of the patient's skull.

It is an object of the invention to provide for an implantable microphone which has low sensitivity to vibration/acceleration and to bone conducted sound. It is also an object of the invention to provide for a corresponding hearing assistance method using such microphone.

According to the invention, these objects are achieved by an implantable microphone as defined in claim 1 and by a hearing assistance method as defined in claim 17, respectively.

The invention is beneficial, in that, by providing a sensor arrangement having a symmetric design of a first pressure sensor and a second pressure sensor with regard to each other, with the membranes of both said pressure sensors being exposed to tissue movement, and by providing for a compensation circuitry for processing the output signals of the first and second pressure sensor, signals resulting from acceleration forces acting on the sensor arrangement can be eliminated in a particularly simple manner. This approach is based on the consideration that acceleration forces are expected to act in the same direction on the first and second membrane, thereby creating similar output signals of the first and second pressure sensors, whereas sound waves in the soft tissue resulting from ambient sound are expected to act on the first and second membrane essentially in opposite directions (since the wavelength of sound waves in tissue is larger than the typical sensor dimensions, the tissue pressure created by a sound wave traveling through the tissue is experienced by the sensor arrangement as a periodically rising and falling pressure which is more or less constant over the entire outer surface of the sensor arrangement, i.e. both membranes experience essentially the same pressure). Consequently, by considering the output signals of both sensors, signals caused by acceleration of the sensor arrangement (and the tissue above/below the sensor arrangement) can be distinguished and separated from signals resulting from sound waves traveling through the tissue around the sensor arrangement. Further, since the sensor arrangement is to be placed in soft tissue, signals resulting from transmission of bone conduction sound are substantially eliminated.

According to a preferred embodiment, the compensation circuit is adapted to divide a signal derived from the sum of the output signals of the first and second sensor by a factor and to add that divided signal to a differential of the output signals of the first and second sensor in order to obtain an acceleration compensated signal.

Preferred embodiments of the invention are defined in the dependent claims.

Hereinafter, examples of the invention will be illustrated by reference to attached drawings, wherein.

Figure 1:
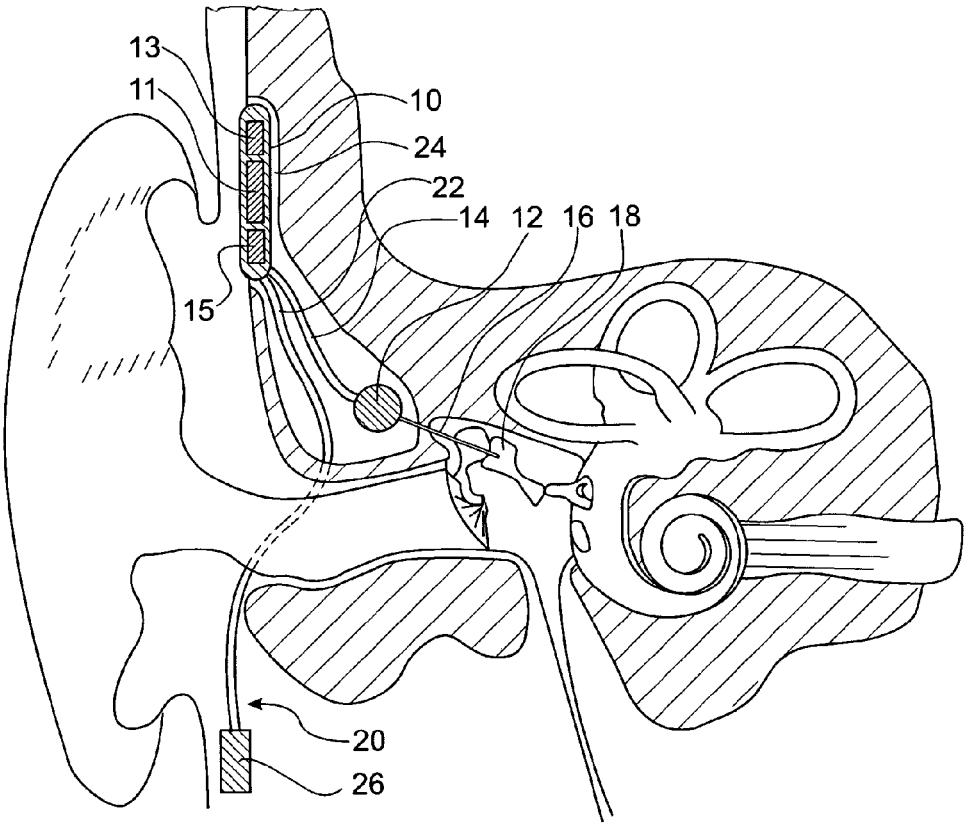
FIG. 1 is a cross-sectional view of an example of a hearing instrument using an implantable microphone according to the invention after implantation.

In the example shown in FIG. 1, a fully implantable hearing aid comprises an implanted housing 10, an implanted output transducer 12 which is connected via an implanted line 14 to the housing 10 and which, in the example of FIG. 1 is designed as an electromechanical transducer for vibrating, via a mechanically coupling element 16, an ossicle 18, and an implanted microphone 20 comprising a sensor arrangement 26 connected via a line 22 to the housing 10.

The housing 10 is accommodated in an artificial cavity 24 created in the mastoid area and contains an audio signal processing unit 11, an electric power supply 13, a driver unit 15 and optionally components for wireless communication with a remote device. The power supply 13 typically includes an induction coil (not shown) for receiving electromagnetic power from a respective power transmission coil of an external charging device (not shown) and a rechargeable battery (not shown). Charging of the power supply 13 may be carried out during night when the user is sleeping.

The audio signal processing unit 11, which typically is realized by a digital signal processor, receives the audio signals captured by the microphone 20 and transforms them into processed audio signals by applying various filtering techniques known in the art. The processed audio signals are supplied to the driver unit 15 which drives the output transducer 12 accordingly, where they are transformed into a respective vibrational output of the transducer 12. Rather then being implemented as an electromechanical output transducer, the output transducer 12 could be any other known type of transducer, such as a floating mass transducer coupled to an ossicle, a cochlear electrode for electrical stimulation of the cochlear or an electrical or mechanical transducer acting directly on the cochlear wall, for example at the round window.

The sensor arrangement 26 of the microphone 20 is placed in soft tissue 28 in a manner that it is completely surrounded by soft tissue, i.e. it neither touches a bone 27 nor is not exposed to air.

Figure 2:
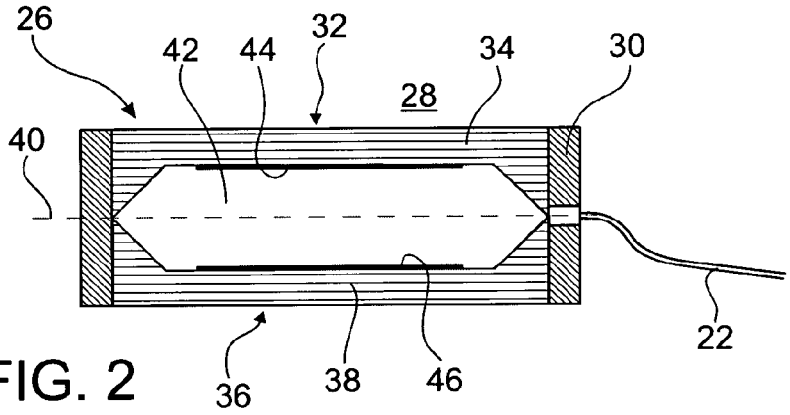
FIG. 2 is a cross-sectional view of an example of an implantable microphone according to the invention.

An example of a sensor arrangement 26 of an implantable microphone 20 according to the invention is shown in FIG. 2 in a cross-sectional view, wherein the sensor arrangement 26 comprises a housing 30, a first pressure sensor 32 having a first membrane 34 and a second pressure sensor 36 having a second membrane 38 which is parallel to the first membrane 34. The first pressure sensor 32 and the second pressure sensor 36 are of a mirror-symmetric design with regard to each other (in FIG. 2, the symmetry plane is indicated at 40). The membranes 34, 38 enclose a gas volume 42 between them, which volume 42 is sealed by the housing 30 and may be filled, for example, with air. The membranes 34, 38 are in direct contact with soft tissue 28 and hence are exposed to tissue movement/vibration due to sound waves and/or body acceleration.

In the example of FIG. 2, the housing 30 is a hollow cylinder with one of the openings being covered by the first membrane 34 and with the other opening being covered by the membrane 38. The housing 30 may be made of titanium. In the example of FIG. 2, the membranes 34, 38 are of circular shape. Each of the membranes 34, 38 carries at its interior side a strain gauge Wheatstone bridge arrangement 44, 46 for generating a sensor output corresponding to the deflection of the respective membrane, which, in turn, corresponds to the forces acting on the respective membrane 34, 38. The wheatstone bridge arrangement 44, 46 may be realized by four implanted piezo resistors.

Preferably, the average density of the sensor arrangement 26 corresponds substantially to the density of the soft tissue 28 (for example, glass has a density of 2.4 to 2.8 g/cm$^3$ and titanium has a density of 4.5 g/cm$^3$, which is well above the density of soft tissue, so that by selecting the volume section of the enclosed gas volume 42 accordingly the average density of the sensor arrangement 26 can be adjusted accordingly). With the average density of the sensor arrangement 26 being close to the density of soft tissue, acceleration artifacts in the sensor signals can be reduced, since thereby relative movement of the sensor arrangement 26 with regard to the surrounding soft tissue 28 can be reduced.

The membranes 34, 38 preferably are formed by micro-machined silicon structures which may be bonded on a glass support. Industrial pressure sensors formed by a silicon micro-machined membrane bonded on a glass support including a wheatstone bridge formed by four implanted piezo resistors are available from the company Intersema Sensoric SA, CH-2022 Bevaix, Switzerland (see for example sensor MS7305D).

Figure 3:
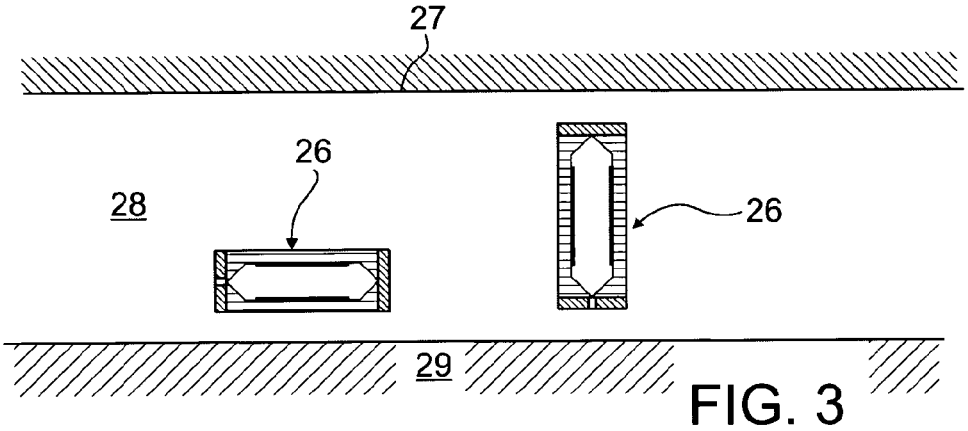
FIG. 3 is a schematic cross-sectional view of the microphone of FIG. 2 after implantation.

FIG. 3 shows two possible orientations of the sensor arrangement 26, wherein the membranes 34, 38 are oriented essentially parallel or perpendicular to the skin surface 29 next to the sensor arrangement 26 (see left hand side and right hand side, respectively, of FIG. 3). A typical size of the sensor arrangement 26 is on the order of 1 to 2 mm, which is smaller than typical skin thickness.

The microphone 20 also includes a compensation circuitry 50 to which the output of the first sensor 32 and the output of the second sensor 36 are supplied separately and which serves to combine the output signals of the first and second sensor 32, 36 in a manner so as to eliminate signals resulting from acceleration forces acting on the sensor arrangement 26. The compensation circuitry 50 can be provided as a unit close to the sensor arrangement 26 or, more preferably, it may be provided as part of the audio signal processing unit 11.

The compensated pressure output P(t) of such symmetric arrangement is given by the weighted linear combination of the differences (D) and sums (S) of the outputs of the symmetric sensors.

$$S + \left(\frac{4\rho_2 V_{eff}}{(\rho_1 + \rho_2)V_1} + 1\right)D = const * P(t)$$

wherein $\rho_2$ is the density of the overlying tissue and $\rho_1$, $V_1$ are the density and volume of the sensor arrangement 26. D is the differential sensor signal output of a subtracting element (indicated at 58 in FIG. 4), and S is the summation signal output by an adder (indicated at 52 in FIG. 4). In fluids the effective volume $V_{eff}$ in the geometry factor $$C = \frac{4\rho_2 V_{eff}}{(\rho_1 + \rho_2)V_1} + 1$$

is not limited, whereas the situation in elastic tissues may be different. Here the effective volume $V_{eff}$ may approach a finite limit $V_{eff}(\infty)$ that has to be determined experimentally.

Figure 4:
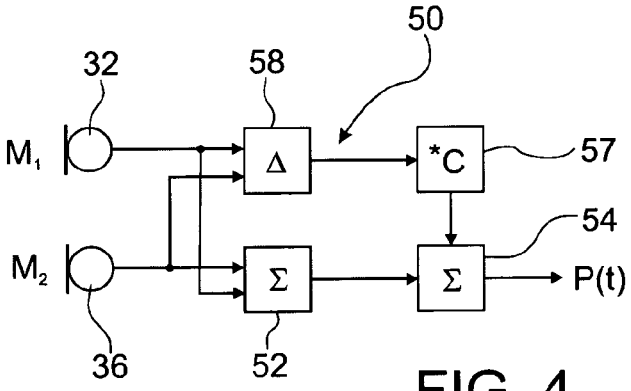
FIG. 4 is an example of a block diagram of a compensation circuit of an implantable microphone according to the invention.

An example of such compensation circuitry 50 is shown in FIG. 4. The compensation circuitry 50 is adapted to multiply, by a multiplying element 57, a signal derived from the difference of the output signals of the first sensor 32 and the second sensor 36, which difference is obtained by a subtracting element 58, by a factor C and to add, by a second adder 54, that multiplied signal to a sum of the output signals of the first sensor 32 and the second sensor 36 obtained by a summating element 52. Thus, at the output of the adder 54 an acceleration compensated signal P(t) is obtained.

Figure 5:
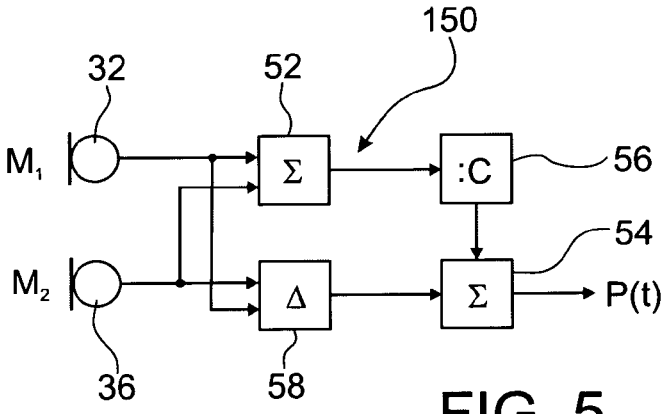
FIG. 5 is an example of a block diagram of a compensation circuit of an implantable microphone according to the invention.

An alternative example of such compensation circuitry 150 is shown in FIG. 5. The compensation circuitry 150 is adapted to divide, by a dividing element 56, a signal derived from the sum of the output signals of the first sensor 32 and the second sensor 36, which sum is obtained by a first adder 52, by a factor C and to add, by a second adder 54, that divided signal to a differential of the output signals of the first sensor 32 and the second sensor 36 obtained by a subtracting element 58. Thus, at the output of the adder 54 an acceleration compensated signal P(t) is obtained.

The output signal P(t) of the compensation circuitry 150 of FIG. 5 is given by $$D + \frac{S}{\left(\frac{4\rho_2 V_{eff}}{(\rho_1 + \rho_2)V_1} + 1\right)} \sim P(t)$$

wherein D is the differential sensor signal output of the subtracting element 58, S is the summation signal output by the adder 52, $V_1$ is the volume of the sensor arrangement 26 and $V_{eff}$ is the effective volume of the overlying tissue 28. In fluids the effective volume may be increased leading to the disappearance of the correction factor $$V_{eff} \xrightarrow{\lim} \infty \frac{1}{C} = 0,$$

whereas the situation in elastic tissues may be different. Here the effective volume $V_{eff}$ may approach a finite limit $V_{eff}(\infty)$ that has to be determined experimentally.

The factor C providing for acceleration compensations depends on the effective thickness of the tissue layer overlaying the membranes 34, 38. This effective tissue layer can be different for movements in different directions perpendicular to the symmetry plane 40 of the sensor arrangement 26 in cases where the overlaying tissue 28 is not equal at both sides of the sensor arrangement 26. Thus, the orientation shown at the left hand side of FIG. 3 results in different factors C for different orientations of the movement. In cases where a symmetric distribution of overlying tissue 28 can be assumed (see right hand side of FIG. 3), the factor C will be identical for both directions of movement.

Moreover, the effective volume of the overlying tissue may be frequency dependent, and as a consequence the factor C will depend on frequency, too. In this case the simple circuit in FIG. 4 that can be realized as analog circuit has to be replaced by a more elaborated one that works with a frequency dependent factor C(f) (such signal processing circuits are known in audio processing).

Various methods may be used to determine the correction factor C: (1) it may be determined experimentally before implantation in tissue or tissue-like material (e.g. ballistic jelly); (2) after implantation, it may be determined by the application of defined body accelerations (for example, by sinoidal rotation in a rotational chair for vestibular testing or an external reference acceleration sensor); or (3) by an adaptive method during use. Although method (1) is the least flexible, it will be adequate in cases with stable effective volume or high effective volume leading to small correction factors. Method (3) has the advantage that changes in the effective volume, for example due to changes in the thickness of the overlaying tissue layer, can be treated more flexible, but it may require a reference acceleration sensor.

For the sensor arrangement of FIG. 2, acceleration forces will act similarly on the first membrane 34 and the second membrane 38 (apart from differences in the overlying tissue 28, which differences are taken into account by the correction factor C), thereby creating similar output signals of the first and second pressure sensor, whereas sound waves in the soft tissue 28 resulting from ambient sound are expected to act on the first membrane 34 and the second membrane 38 essentially in opposite directions (since the wavelength of sound waves in tissue is larger than the typical sensor dimensions, the tissue pressure created by a sound wave traveling through the tissue is experienced by the sensor arrangement as a periodically rising and falling pressure which is more or less constant over the entire outer surface of the sensor arrangement 26, i.e. both membranes experience essentially the same pressure). Consequently, by processing the output signals of both sensors 32, 36 in the compensation circuitry 50, signals caused by acceleration of the sensor arrangement 26 (and the tissue 28 above/below the sensor arrangement) can be distinguished and separated from signals resulting from sound waves traveling through the tissue 28 around the sensor arrangement 26.

Figure 6:
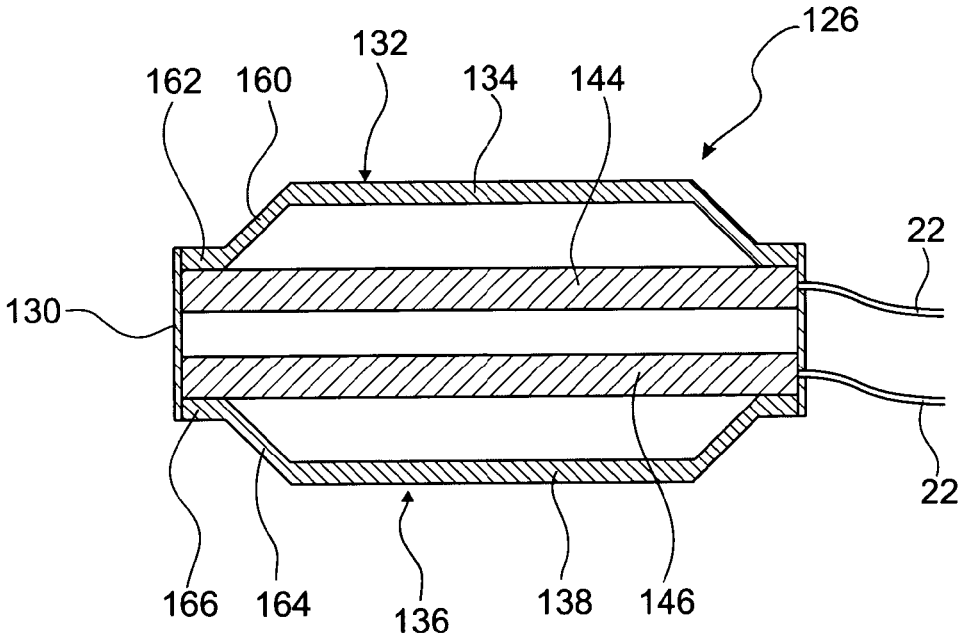
FIG. 6 is a view link FIG. 2, wherein an alternative example of an implantable microphone according to the invention is shown.

An alternative example of a sensor arrangement 126 of an implantable microphone 20 according to the invention is shown in FIG. 6 in a cross-sectional view, wherein the sensor arrangement 126 comprises a housing 130, a first pressure sensor 132 having a first membrane 134 and a second pressure sensor 136 having a second membrane 138 which is parallel to the first membrane 134. The first pressure sensor 132 and the second pressure sensor 136 are of a mirror-symmetric design with regard to each other. The membranes 134, 138 are in direct contact with soft tissue 28 and hence are exposed to tissue movement/vibration due to sound waves and/or body acceleration.

In the example of FIG. 6, the housing 130 is a hollow cylinder, with a first piezo-electric sensor substrate 144 and a second piezo-electric sensor substrate 146 being located within the housing parallel to each other. The first membrane 134 is carried by a slanted portion 160 which is fixed via a lip portion 162 to a peripheral portion of the first sensor substrate 144, for example by an adhesive layer (not shown), and the second membrane 138 is carried by a slanted portion 164 which is fixed via a lip portion 166 to a peripheral portion of the second sensor substrate 146. The first pressure sensor 132 closes one end of the housing 130, and the second pressure sensor 136 closes the other end of the housing 130. Due to the geometry of the sensors 132, 136 deflection of the membranes 134, 138 caused by movement/vibration of the adjacent tissue normal to the membrane 134, 138 results in forces acting on the respective substrate 144, 146 in directions parallel to the plane of the respective substrate 144, 146, thereby creating a sensor output of each sensor substrate 144, 146 corresponding to the forces acting on the respective membrane 134, 138 (examples of such flextensional sensors are described, for example, in U.S. Pat. No. 6,554,761 B1).

The membranes 134, 138 may be of circular shape, with the membranes 134, 138 and the respective slanted portions 160, 166 then forming a frustro-conical section. The output of the sensors 132, 136 is processed analogously to that of the sensors 32, 36 of FIG. 2.

The principle of the invention can be applied to not only to displacement sensors but also to velocity and acceleration sensors.

In general, a plurality of microphones according to the invention may be implanted in a manner so as to form a microphone array. In view of the achievable small size of the individual microphones, the microphones according to the invention are particularly well suited for application.

The invention claimed is:

1. A fully implantable hearing instrument comprising:
an implantable microphone for placement in soft tissue, comprising:
a sensor arrangement comprising:
a housing;
a first pressure sensor having a first membrane configured to be exposed to surrounding soft tissue and configured to output a first output signal; and
a second pressure sensor having a second membrane configured to be exposed to the surrounding soft tissue and configured to output a second output signal; and
a compensation circuitry configured to combine the first output signal of the first pressure sensor and the second output signal of the second pressure sensor in relation to a correction factor (C) to obtain an acceleration compensated signal (P) and to eliminate signals resulting from acceleration forces acting on the sensor arrangement,
wherein the first and the second pressure sensors are of a mirror-symmetric design with regard to each other, with the first and the second membranes being arranged parallel to each other; and
an implantable output transducer configured to stimulate a patient's hearing based on the combined first and second output signals.

2. The fully implantable hearing instrument of claim 1, wherein the compensation circuitry is configured to divide a signal derived from a sum of the first output signal and the second output signal by the factor (C) and to add the signal divided by the compensation circuitry to a differential of the first output signal and the second output signal in order to obtain the acceleration compensated signal (P).

3. The fully implantable hearing instrument of claim 1, wherein the compensation circuitry is configured to multiply a signal derived from a differential of the first output signal and the second output signal by the factor (C) and to add the signal multiplied by the compensation circuitry to a sum of the first output signal and the second output signal in order to obtain the acceleration compensated signal (P).

4. The fully implantable hearing instrument of claim 1, wherein an average density of the sensor arrangement corresponds substantially to a density of the surrounding soft tissue.

5. The fully implantable hearing instrument of claim 1, wherein the first and the second membranes enclose a gas volume sealed by the housing.

6. The fully implantable hearing instrument of claim 1, wherein the first and the second membranes are made of micromachined silicon.

7. The fully implantable hearing instrument of claim 1, wherein the housing is a hollow cylinder having a first opening and a second opening, the first opening of the hollow cylinder being covered by the first membrane and the second opening of the hollow cylinder being covered by the second membrane.

8. The fully implantable hearing instrument of claim 1, wherein the housing is made of titanium.

9. The fully implantable hearing instrument of claim 1, wherein each of the first membrane and the second membrane carries at least one strain sensitive element for respectively generating the first output signal and the second output signal.

10. The fully implantable hearing instrument of one claim 1, wherein each of the first membrane and the second membrane carries a strain gauge Wheatstone bridge arrangement for respectively generating the first output signal and the second output signal.

11. The fully implantable hearing instrument of claim 10, wherein the strain gauge Wheatstone bridge arrangement is provided at an interior side of each of the first and the second membranes.

12. The fully implantable hearing instrument of claim 10, wherein the strain gauge Wheatstone bridge arrangement comprises four piezoresistors implanted within each of the first and the second membranes.

13. The fully implantable hearing instrument of claim 1, wherein each of the first membrane and the second membrane is fixed via a slanted portion at a peripheral portion of a respective strain sensitive substrate for respectively generating the first output signal and the second output signal, with each of the first membrane and the second membrane extending spaced apart and parallel to the respective strain sensitive substrate.

14. The fully implantable hearing instrument of claim 13, wherein the respective strain sensitive substrate comprises a piezo-electric material.

15. The fully implantable hearing instrument of claim 1, wherein the first and the second membranes are of circular or rectangular shape.

16. A fully implantable hearing instrument comprising:
a microphone comprising:
a sensor arrangement comprising:
a housing;
a first pressure sensor having a first membrane configured to be exposed to surrounding soft tissue and configured to output a first output signal; and
a second pressure sensor having a second membrane configured to be exposed to the surrounding soft tissue and configured to output a second output signal; and
a compensation circuitry configured to combine the first output signal of the first pressure sensor and the second output signal of the second pressure sensor in relation to a correction factor (C) to obtain an acceleration compensated signal (P) and to eliminate signals resulting from acceleration forces acting on the sensor arrangement,
wherein the first and the second pressure sensors are of a mirror-symmetric design with regard to each other, with the first and the second membranes being arranged parallel to each other;
an audio signal processing unit for further processing the first output signal and the second output signal; and
an output transducer for stimulating a patient's hearing according to the first output signal and the second output signal that are further processed by the audio signal processing unit.

17. A method of providing hearing assistance to a user, comprising:

capturing first pressure signals from a first pressure sensor having a first membrane exposed to surrounding soft tissue;

capturing second pressure signals from a second pressure sensor having a second membrane exposed to the surrounding soft tissue;

wherein the first and the second pressure sensors form part of an implanted sensor arrangement for soft tissue placement, are configured to capture ambient sound penetrating into said soft tissue, and are of a mirror-symmetric design with regard to each other, with the first and the second membranes being arranged in parallel with regard to each other;

combining the first and the second pressure signals in relation to a correction factor (C) to obtain an acceleration compensated signal (P) and to eliminate pressure signals resulting from acceleration forces acting on the sensor arrangement;

further processing the first and the second pressure signals; and stimulating the user's hearing, by an implanted output transducer, according to the further processing of the first and the second pressure signals.

18. The method of claim 17, wherein the first membrane and the second membrane are oriented essentially parallel or perpendicular to a skin surface next to the sensor arrangement.

* * * * *